US009374635B2

(12) United States Patent
Kole et al.

(10) Patent No.: US 9,374,635 B2
(45) Date of Patent: Jun. 21, 2016

(54) EARPIECE INTEGRATED MAGNETIC SHIELDING FOR MITIGATING INGRESS OF MAGNETIC PARTICLES

(71) Applicant: Apple Inc., Cupertino, CA (US)

(72) Inventors: Jared M. Kole, San Francisco, CA (US); Martin J. Auclair, Cupertino, CA (US); Ruchir M. Dave, San Jose, CA (US); Scott P. Porter, San Jose, CA (US); Benjamin M. Russo, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/590,842

(22) Filed: Jan. 6, 2015

(65) Prior Publication Data

US 2016/0073182 A1 Mar. 10, 2016

Related U.S. Application Data

(63) Continuation of application No. PCT/US2015/010333, filed on Jan. 6, 2015.

(60) Provisional application No. 62/047,441, filed on Sep. 8, 2014.

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 1/026; H04R 2499/11; H04R 2499/15
USPC ..... 381/189
See application file for complete search history.

(56) References Cited

U.S. PATENT DOCUMENTS

2007/0092093 A1* 4/2007 Shim ..... H04R 9/02 381/189
2008/0298630 A1 12/2008 Won et al.
2010/0166201 A1* 7/2010 Shim ..... H04R 9/02 381/71.1

FOREIGN PATENT DOCUMENTS

JP 2004222208 8/2004
KR 20010079380 8/2001
KR 20080008998 1/2008

OTHER PUBLICATIONS

PCT Application No. PCT/US2015/010333—International Search Report and Written Opinion dated Jun. 8, 2015.

* cited by examiner

*Primary Examiner* — Tuan D Nguyen
(74) *Attorney, Agent, or Firm* — Downey Brand LLP

(57) ABSTRACT

This document describes methods and apparatus for reducing a magnetic field emitted by an earpiece assembly from extending substantially outside a device associated with the earpiece assembly. Where the earpiece assembly is susceptible to ingress of magnetically attractable particles into the earpiece assembly such a reduction can prolong an operational life of the earpiece assembly. By insert molding magnetically permeable materials throughout an enclosure that surrounds and supports a permanent magnet of the earpiece assembly, a portion of a magnetic field emanating from the permanent magnet that extends outside the device can be substantially reduced or redirected so that the magnetic field ceases to draw the magnetically attractable particles into the earpiece assembly.

19 Claims, 10 Drawing Sheets

EARPIECE INTEGRATED MAGNETIC SHIELDING FOR MITIGATING INGRESS OF MAGNETIC PARTICLES

CROSS REFERENCE TO RELATED APPLICATIONS

This is a continuation of International PCT Application No. PCT/US15/10333, filed Jan. 6, 2015, and claims priority to U.S. Provisional Patent Application No. 62/047,441, filed Sep. 8, 2014, and entitled "EARPIECE INTEGRATED MAGNETIC SHIELDING FOR MITIGATING INGRESS OF MAGNETIC PARTICLES", which is herein incorporated by reference in its entirety.

This application is related to (i) U.S. Provisional Patent Application No. 62/047,567, filed Sep. 8, 2014, and entitled "ACOUSTIC MESH AND METHODS OF USE FOR ELECTRONIC DEVICES", and (ii) U.S. Provisional Patent Application No. 62/047,561, filed Sep. 8, 2014, and entitled "SHIELD FOR ACOUSTIC DEVICE".

FIELD

The described embodiments relate generally to methods for preventing contaminates from entering a device housing. More particularly, the present embodiments relate to methods and apparatus for preventing or at least reducing a rate at which a magnetic element of a voice coil motor draws magnetically attractable particles into the device housing.

BACKGROUND

As an electronic device assumes progressively thinner profiles, internal electronic components suitable for performing various tasks can be forced closer towards various openings of the electronic device. In some cases, a magnet responsible for generating audio signals is purposefully placed near an opening in the electronic device to optimize an emitted audio signal. Unfortunately, a magnetic field emitted by such a magnet can cause various magnetically attractable particles to be drawing through the opening. These magnetically attractable contaminates can accumulate within the electronic device to a point at which functionality of internal components of the electronic device suffer degradation and in some cases complete failure. While a protective screen positioned across the opening can be effective to keep larger particles out, reduction in aperture of the screen below a certain threshold can substantially degrade the passage of signals along the lines of audio signals. For this reason, modern designs often allow small particles on the order of below 10 microns to pass into the electronic device. In some embodiments, a build up of the small particles can inhibit movement of audio generating components, thereby degrading and in some cases preventing operation of the audio components.

SUMMARY

This paper describes various embodiments that relate to methods and apparatus for preventing ingress of magnetically attractable particles through an audio port.

A speaker assembly for an electronic device is disclosed. The speaker assembly includes at least the following: a speaker that includes a magnetic element that emits a magnetic field used to actuate an acoustic membrane that generates audio signals; and a speaker enclosure substantially surrounding the speaker assembly and defining an opening that provides an outlet for the audio signals produced by the acoustic membrane. The speaker enclosure includes magnetically permeable material positioned proximate the opening in a manner that shapes the magnetic field such that magnetically attractable particles from an external environment are inhibited from being magnetically drawn through the opening.

A speaker assembly configured to be affixed to an interior surface of a housing of an electronic device is disclosed. The speaker assembly includes at least the following: a speaker enclosure defining an opening leading towards a position at which an opening in the interior surface of the housing is positioned when the speaker assembly is affixed to the interior surface of the housing, the speaker enclosure including magnetically permeable material arranged around the opening defined by the speaker enclosure; a magnet disposed within and substantially surrounded by the speaker enclosure; an electrically conductive ring electrically coupled with a power supply that supplies the electrically conductive ring with modulated current during operation of the speaker assembly; and a diaphragm coupled with and disposed across the electrically conductive ring. The electrically conductive ring and the magnet cooperate to vibrate the electrically conductive ring so that the diaphragm generates an audio signal that is transmitted through the opening defined by the speaker enclosure, and the magnetically permeable material is positioned to redirect a portion of the magnetic fields extending outside of the electronic device without obstructing the opening defined by the speaker enclosure.

An electronic device is disclosed and includes at least the following: a device housing defining a speaker opening; and a speaker assembly affixed to an interior facing surface of the device housing that includes the speaker opening. The speaker assembly includes at least the following: a speaker enclosure defining an opening oriented towards the speaker opening in the interior surface of the device housing, the speaker enclosure comprising magnetically permeable material distributed around the opening defined by the speaker enclosure; a magnet disposed within and substantially surrounded by the speaker enclosure; and an acoustic membrane stretched over an electrically conductive ring, the electrically conductive ring configured to emit a shifting magnetic field that cooperates with a magnetic field emitted by the magnet to cause the acoustic membrane to generate an audio output that is transmitted through the opening of the speaker enclosure and the speaker opening.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
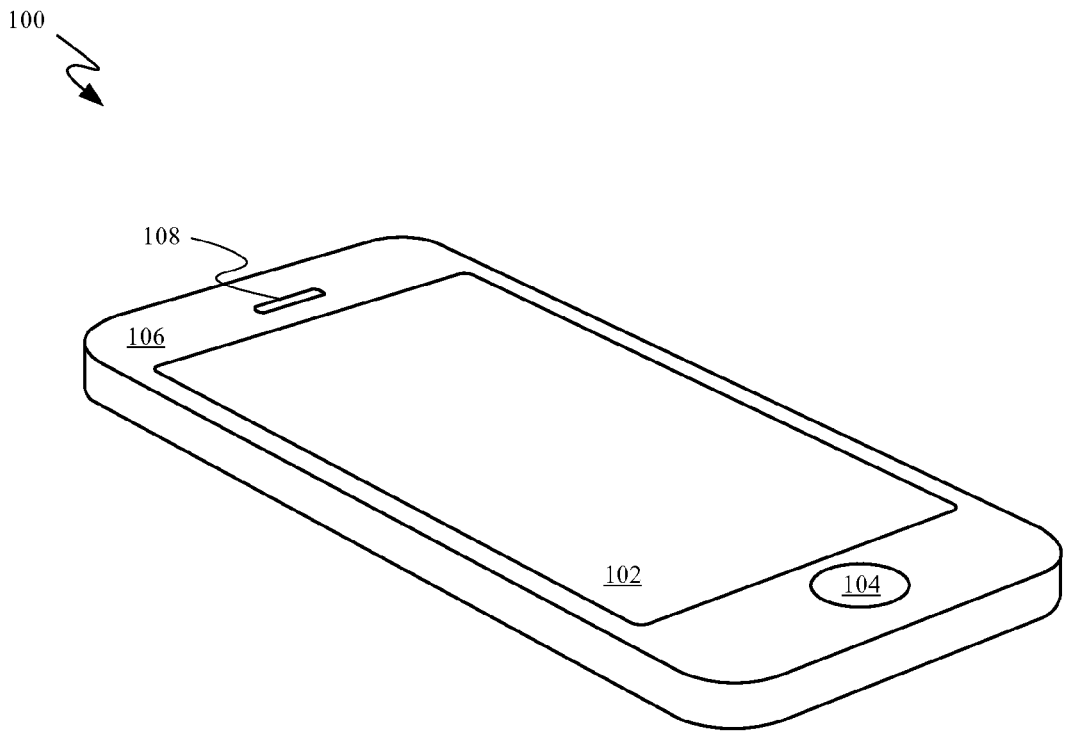
FIG. 1 shows perspective views of an electronic device suitable for use with the described embodiments.

This application is related to another provisional patent application entitled, "Acoustic mesh features of an electronic device" that discusses a number of acoustic and cosmetic mesh embodiments to include various stackups0, mesh stiffener elements and three dimensional mesh configurations.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Audio components often use magnetic elements for converting a signal that includes auditory information into sound waves. By modulating an amount of current circulating through an electrically conductive coil a shifting magnetic field can be created that interacts with a magnetic field associated with a permanent magnet. The electrically conductive coil and a diaphragm attached thereto can then move in response to a changing magnetic force caused by interactions between the magnetic fields to produce audio waves. Depending upon a position of the permanent magnet within a device housing, the magnetic field emitted by the permanent magnet can continuously attract magnetically attractable particles external to the housing. Because the permanent magnet is generally arranged close to an opening in the housing to facilitate exit of the audio waves generated by the audio components, the magnetically attractable particles tend to be drawn into the housing through the opening. Although such an opening is typically covered with a porous mesh, small magnetically attractable particles with a diameter smaller than the pores of the porous mesh can be drawn through the porous mesh. Once the magnetically attractable particles enter the housing they are drawn towards the permanent magnet and tend to build up on the diaphragm, especially given that the diaphragm is typically positioned just above the permanent magnet. Over time the build up of even small magnetically attractable particles can degrade or even prevent movement of the diaphragm.

One solution to this problem is to place a magnetically permeable material between the permanent magnet and a wall of the device housing through which the magnetic field of the permanent magnet extends. The magnetically permeable material can be arranged around a pathway between the opening and the permanent magnet so that a flow of audio waves out of the housing remains unimpeded. Notwithstanding the opening, the magnetically permeable material can redirect the magnetic field of the permanent magnet so that the magnetic field is less concentrated just above the opening leading into the device. In this way, the ingress of magnetically attractable particles can be reduced to a level at which magnetically attractable particles are less likely to prevent or degrade movement of the diaphragm. With the exception of an open audio pathway leading out of an earpiece enclosure surrounding the audio component, magnetically permeable material can be insert-molded within the earpiece enclosure so that the permanent magnet is substantially surrounded by magnetically permeable material. The inclusion of generous amounts of magnetically permeable material immediately around the permanent magnet can also reduce a likelihood of the permanent magnet interfering with other internal electrical components disposed within the housing. It should be noted that in addition to reducing the effect of the external magnetic field, by insert-molding robust magnetically permeable material into the earpiece enclosure a thickness of the earpiece enclosure can be considerably reduced, when compared with a plastic earpiece enclosure, without impairing a structural soundness of the earpiece enclosure. The thinned earpiece enclosure walls can also enhance audio performance of the audio component by increasing the volume available to the transducer.

These and other embodiments are discussed below with reference to FIGS. 1-9; however, those skilled in the art will readily appreciate that the detailed description given herein with respect to these figures is for explanatory purposes only and should not be construed as limiting.

FIGS. 1A-1B show perspective views of electronic device 100 suitable for use with the described embodiments. Electronic device 100 includes display assembly 102. Display assembly 102 can be utilized to present a touch based user interface to a user of electronic device 100. In some embodiments, electronic device 100 also includes another user interface element along the lines of button 104. Button 104 can be configured to perform specific functions depending on an operating state of electronic device 100. In some embodiments, button 104 can be configured to return electronic device 100 to a higher level menu and/or terminate use of a currently selected application. In other embodiments, a function of button 104 can be user configurable. It should be noted that electronic device 100 can include many other buttons and or user interface elements not specifically discussed. A top surface of electronic device 100 can be covered by cover glass 106. Cover glass 106 can define an opening 108 associated with an audio port configured to generate audio signals generated within electronic device 100 that exit electronic device 100 through opening 108. In some embodiments, the audio signals can be along the lines of audio signals associated with telephone conversations. In other embodiments, media files can be played back through the audio port. Opening 108 can be covered by a layer or multiple layers of mesh that prevents most contaminates from entering into electronic device 100, while allowing audio signals to pass through the layers of mesh substantially unhindered. In some embodiments, the mesh layer(s) can have openings no larger than about 10 microns in diameter.

Figure 2:
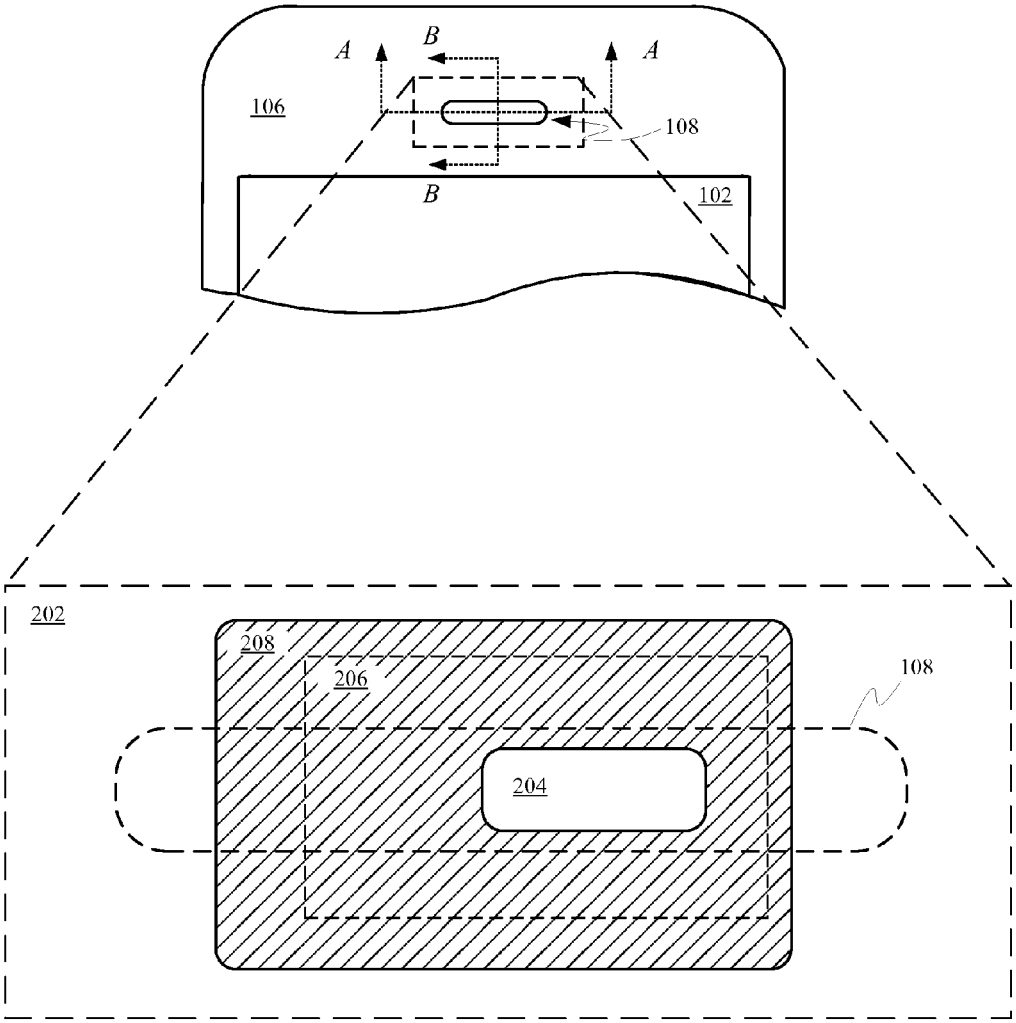
FIG. 2 shows a close up top view of an upper portion of the electronic device depicted in FIG. 1.

FIG. 2 shows a close up top view of an upper portion of electronic device 100. In particular, opening 108 of the audio port is depicted. Close up x-ray view 202 shows a number of internal components associated with the audio port relative to opening 108. Snout region 204 represents an aperture through which audio signals generated by vibratory motion associated with components interacting with magnet 206 exit electronic device 100. Earpiece enclosure 208 substantially surrounds magnet 206 and acts as a shunt to substantially prevent a magnetic field associated with magnet 206 from affecting objects external to electronic device 100 when enclosure 208 includes magnetically permeable material. This can be particularly important when magnet 206 is a permanent magnet as the magnetic field associated with magnet 206 would be persistently present. Enclosure 208 doesn't extend over snout region 204, so that audio signals can pass unhindered through snout region 204. While leaving snout region 204 open can reduce an effectiveness of enclosure 208 as a shielding member for magnet 206, earpiece enclosure 208 can still attenuate enough of the magnetic field emitted from magnet 206 to prevent the magnetic field from extending substantially outside electronic device 100. Positioning enclosure 208 between magnet 206 and cover glass/protective cover 106 can limit or in certain embodiments preclude an amount of electromagnetic radiation from leaving electronic device 100 even though enclosure 208 doesn't completely cover magnet 206.

Figure 3:
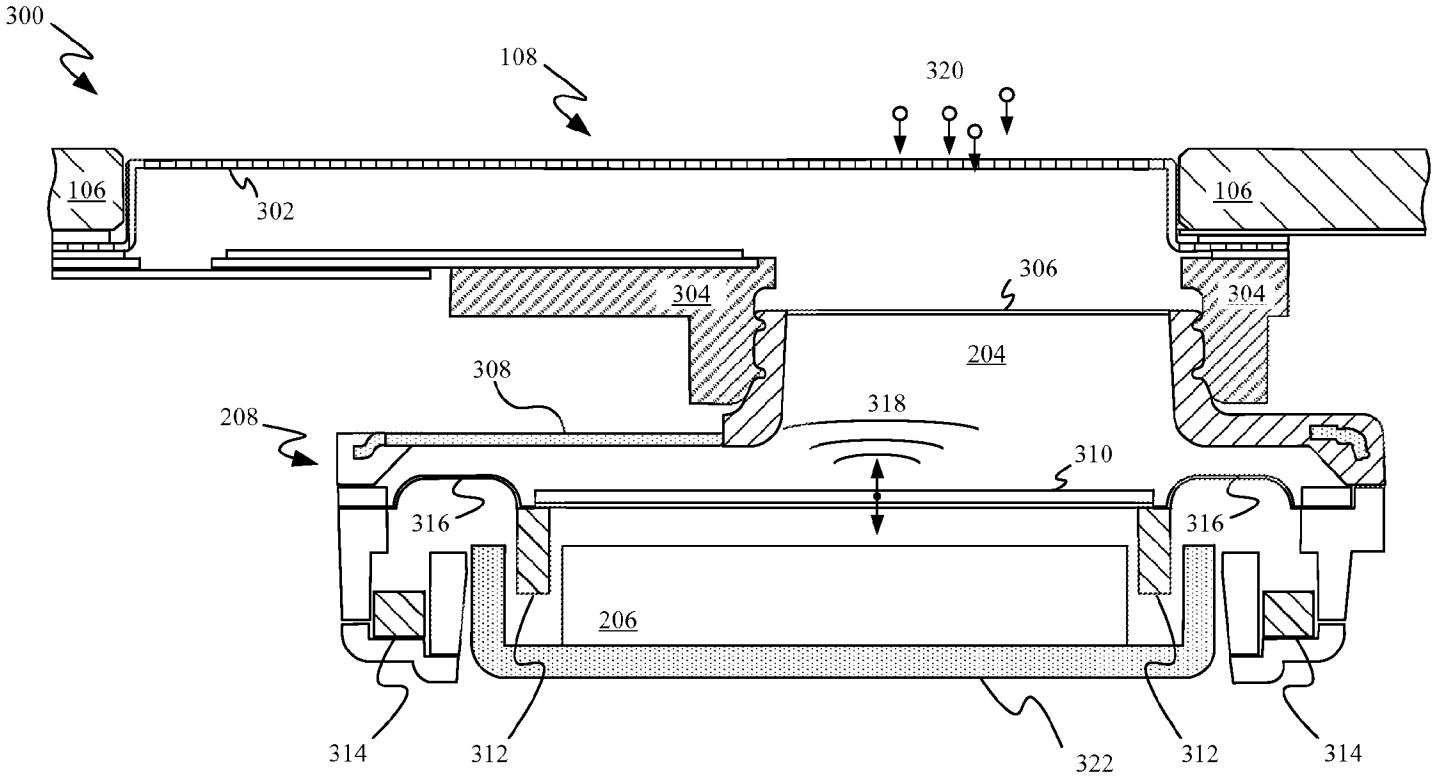
FIG. 3 shows a partial cross-sectional view of the electronic device in accordance with section line A-A.

FIG. 3 shows a partial cross-sectional view of electronic device 100 in accordance with section line A-A that includes earpiece assembly 300. Earpiece assembly 300 is anchored within opening 108 defined by cover glass 106. Cosmetic mesh 302 covers opening 108 and provides an overlay that presents a cosmetically pleasing cover for earpiece assembly 300. Cosmetic mesh 302 can also be useful for preventing some contaminates from entering electronic device 100. Cosmetic mesh 302 can be affixed to an inside surface of cover glass 106 in various ways. For example, cosmetic mesh can be adhesively coupled to an inside surface of cover glass 106. In some embodiments, a frame member can be used to keep cosmetic mesh 302 stretched across opening 108. A remaining portion of earpiece assembly 300 can also be adhered to cover glass 106. In some embodiments, an injection molded portion 304 can suspend down from the cover glass to define a channel depicted as snout region 204. Snout region 204 can be covered by acoustic mesh 306 that can in cooperation with cosmetic mesh 302 operate to prevent contaminates from passing into a portion of earpiece assembly 300 that includes contaminate sensitive components along the lines of audio components. In some embodiments, injection molded portion 304 can be formed around magnetically permeable material 308 along the lines of high carbon steel. Magnetically permeable material 308 redirects a portion of a magnetic field emitted from magnet 206 so the magnetic field does not extend substantially past cover glass 106, which will be illustrated in FIGS. 4A-4B. In some specific embodiments, magnetically permeable material 308 can take the form of magnetically permeable stainless steel along the lines of SUS-430, which provides a good balance between strength and magnetic permeability. In this way, SUS-430 can provide both robust structural support for earpiece enclosure 208 that substantially surrounds magnet 206 and magnetic field shielding to at least mitigate a strength of a magnetic field proximate to opening 108. It should also be noted that because magnetically permeable material 308 can provide robust structural support that a thickness of earpiece enclosure 208 can be reduced. The reduced thickness can allow earpiece enclosure 208 to fit in a tighter space and accommodate somewhat larger components to surround it. In some embodiments the thinned walls can also help to enhance an output of audio components disposed within earpiece enclosure 208 as vibration of the walls can be improved which can improve acoustic transmission of audio waves outside electronic device 100.

Also depicted in FIG. 3 is diaphragm 310. Diaphragm 310 can be a semi-rigid acoustic membrane formed from material that provides excellent properties for providing high quality auditory output. In some embodiments, the material can be paper; however, any number of materials can be alternatively employed, such as for example paper composites, polypropylene, mineral/fiber filled polypropylene, thermoplastic polyurethane (TPU), thermoplastic elastomers (TPE), and polyether ether ketone (PEEK). Diaphragm 310 is positioned across electrically conductive coil 312. Electrically conductive coil 312 can provide a platform across which diaphragm 310 can be stretched or at least secured. In some embodiments, electrically conductive coil 312 can be formed from copper. Although not depicted, coil 312 can be electrically coupled with a power supply that provides a changing amount of electricity. A longitudinal axis of electrically conductive coil 312 can be substantially aligned with a longitudinal axis of magnet 206 to facilitate interaction between magnetic fields emitted by the two elements. By changing an amount of electricity routed through coil 312 a shifting magnetic field can be emitted from electrically conductive coil 312 that interacts with a magnetic field emanating from magnet 206.

In some embodiments, earpiece assembly 300 can include an additional electrically conductive coil 314. Electrically conductive coil 314 can be utilized to provide an additional magnetic field that interacts with the magnetic field produced by magnet 206 and the magnetic field produced by electrically conductive coil 312. In some embodiments, all three magnetic fields can cooperate to create magnetic signatures not otherwise possible. For example, current in both electrically conductive coils 312 and 314 can run in opposite directions while being modulated in different patterns. In other embodiments, current modulations and amplitudes can be at least partially synchronized. Because diaphragm 310 is only flexibly connected to the enclosure by flexible connectors 316, diaphragm 310 can be vertically displaced to generate sound waves 318 in the direction indicated by the arrows over diaphragm 310. The vertical displacement can be driven at a frequency that causes sound waves 318 to match audio content specified in data stored and/or received by electronic device 100. In some embodiments, flexible connectors 316 can be configured to electrically couple electrically conductive coil 312 to the power supply. In other embodiments, electrically conductive coil 312 can be electrically coupled to the power supply by a separate electrical connector (not depicted). Regardless of how the coils are powered, the varying Lorentz force produced by modulating current through the electrically conductive coil or coils can cause vertical displacement to occur in a desired pattern that corresponds to audio information received by electronic device 100. It should be noted that in addition to insert molding magnetically permeable material 308 into components surrounding magnet 206, magnetic shunt 322 can be positioned directly below magnet 206. In some embodiments, magnetic shunt 322 can be configured to snap into and be held within an opening defined by an insert-molded portion of earpiece enclosure 208. Magnetic shunt 322 can substantially prevent magnetic radiation from extending directly below magnet 206. This can be particularly beneficial where magnetically sensitive components along the lines of a printed circuit board are located below magnetic shunt 322.

Figure 4A:
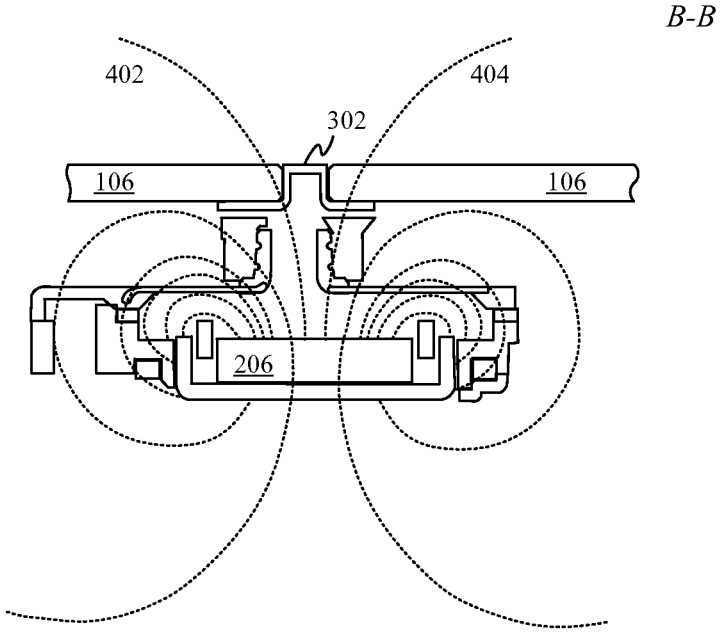
FIGS. 4A-4B show partial cross-sectional side views of the electronic device of FIG. 2 in accordance with section line B-B, overlaid by representations of magnetic field lines emanating from a magnet.
Figure 4B:
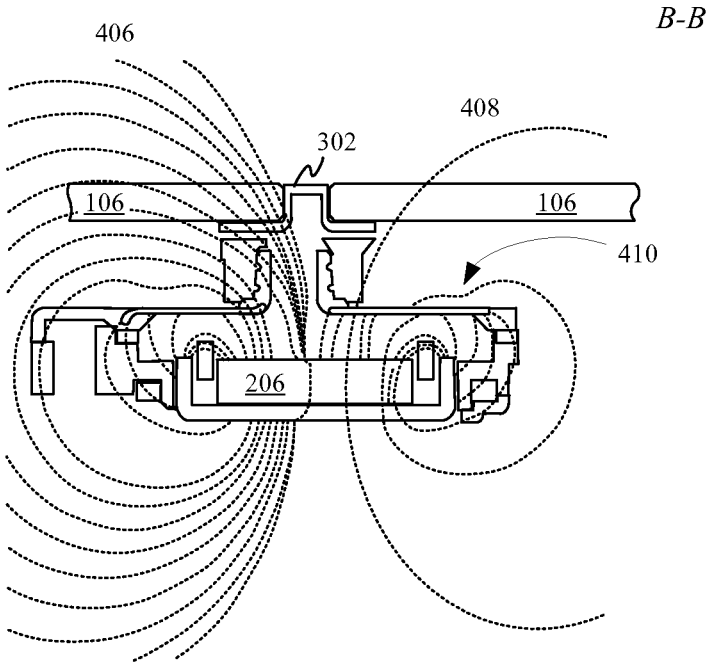

FIGS. 4A-4B show partial cross-sectional side views of electronic device 100 in accordance with section line B-B overlaid by representations of a magnetic field emanating from magnet 206. FIG. 4A shows a representation of magnetic fields 402 and 404 resulting when no magnetically permeable shielding material is included in enclosure 208. For example, when SUS-304 is utilized to surround and strengthen an enclosure surrounding magnet 206, the magnetic field emitted from magnet 206 is substantially unaffected. FIG. 4B shows a representation of magnetic fields 406 and 408 emanating from magnet 206. Noticeably, a portion 410 of magnetic field 408, made up of a number of magnetic field lines, bends substantially away from cover glass 106 as a result of magnetically permeable material insert molded within earpiece enclosure 208 surrounding magnet 206.

Figure 5:
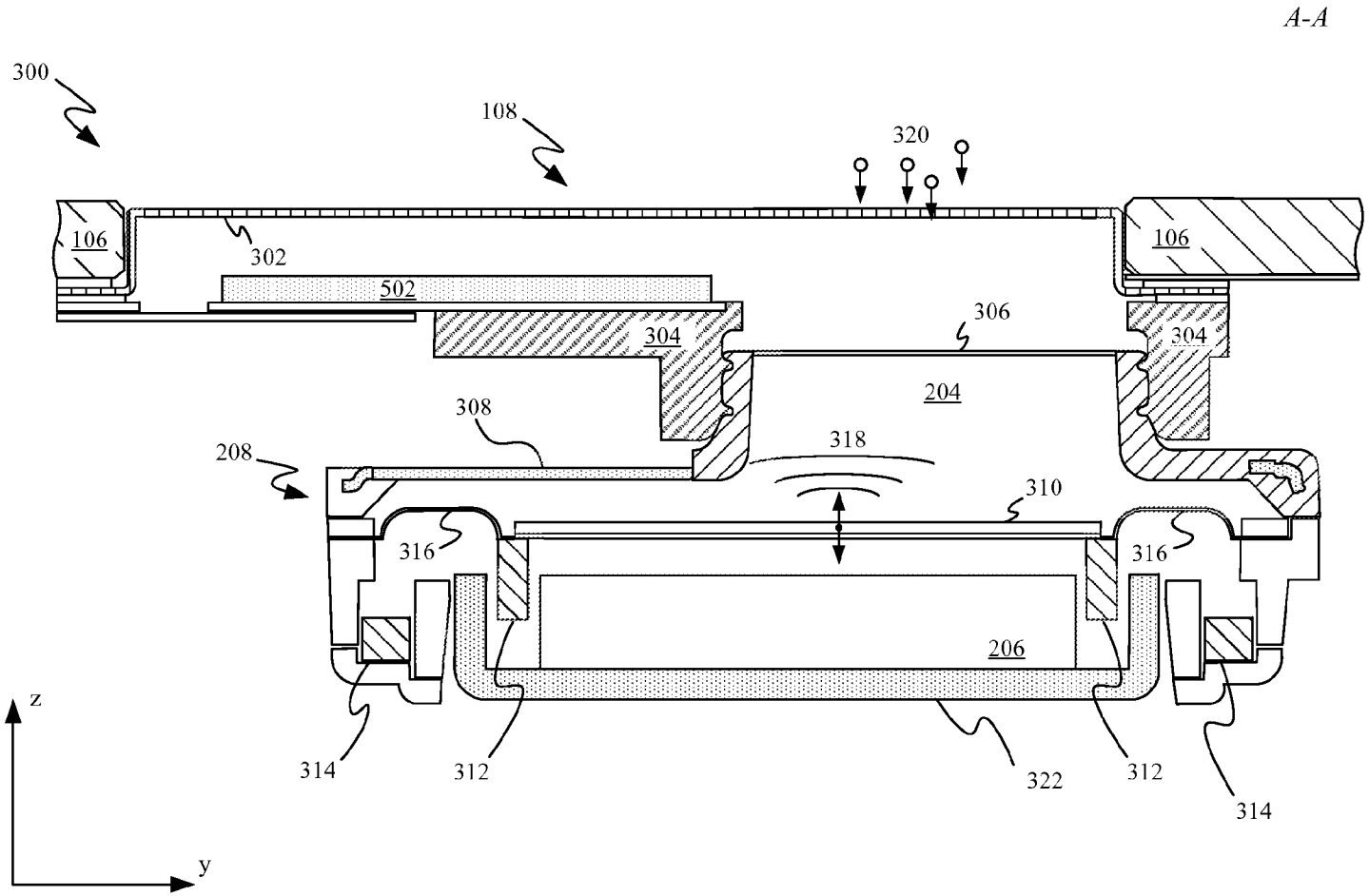
FIG. 5 shows an alternative embodiment in which additional magnetically permeable material along the lines of mu-metal is added within the electronic device and above a magnetic component of an earpiece assembly.

FIG. 5 shows an alternative embodiment in which additional magnetically permeable material along the lines of mu-metal is added between cosmetic mesh 302 and magnet 206 of earpiece assembly 300. For example, magnetically permeable material 502 is depicted in place below cosmetic mesh 302. By placing additional magnetically permeable material 502 between magnet 206 and cosmetic mesh 302 a strength of a magnetic field extending outside electronic device 100 can be spread out and redirected, thereby further reducing a rate at which magnetically attractable particles are drawn into electronic device 100. In this way, an intense magnetic field localized just above magnet 206 can be distributed more evenly, causing a much lower likelihood of magnetically attractable particles 320 from being drawn into electronic device 100. In particular, by reducing a Z-component of the emitted magnetic field a force driving magnetically attractable particles 320 towards cosmetic mesh 302 can be commensurably reduced.

Figure 6:
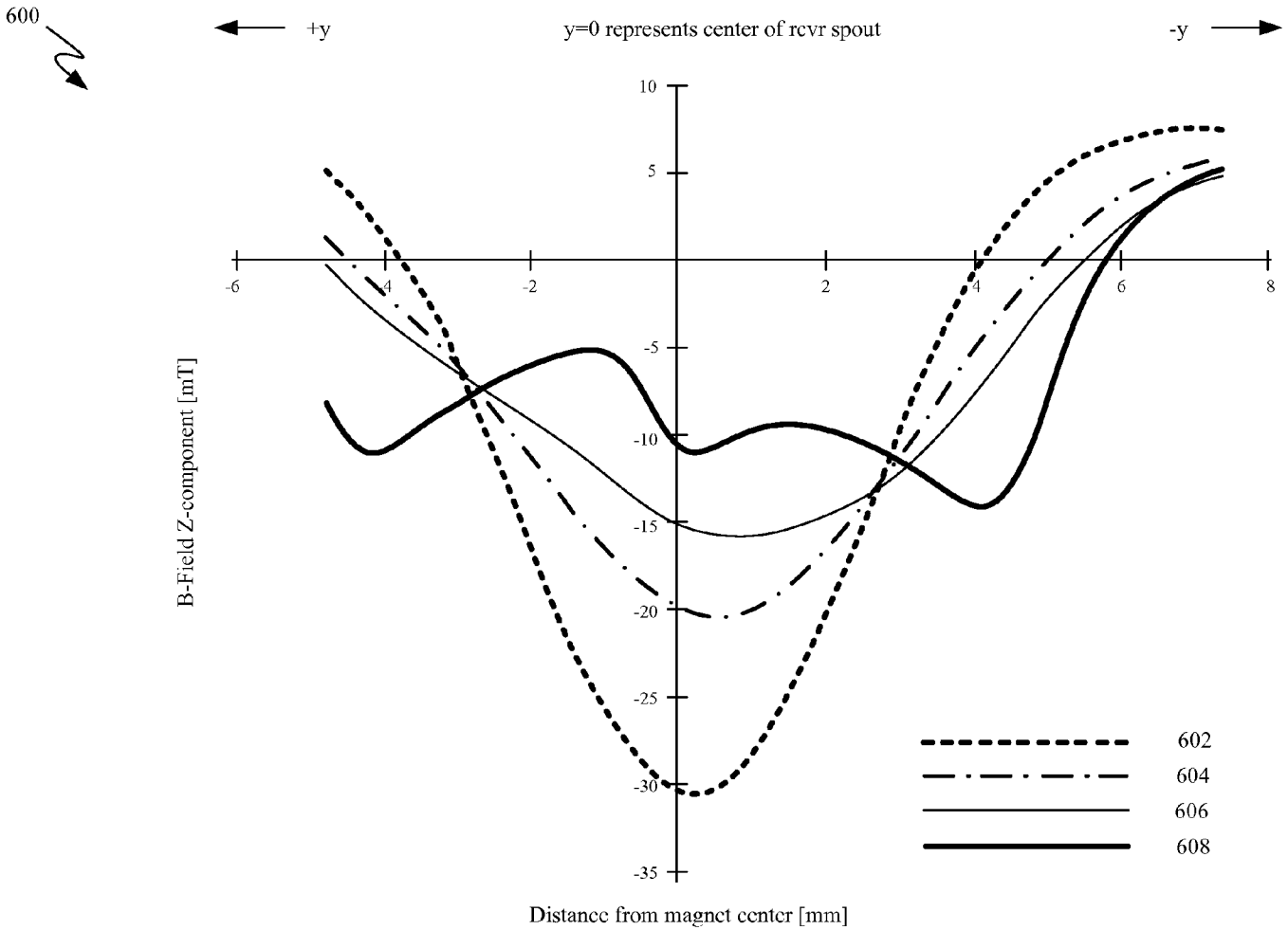
FIG. 6 shows a graph representing a strength of a magnetic field present along a top surface of the electronic device just above a magnetic component of an earpiece speaker assembly.

FIG. 6 shows a graph 600 representing a magnitude of a Z-component of a magnetic field present along a top surface of an electronic device just above a magnetic component of an earpiece speaker assembly. The Z-component of the magnetic field corresponds to an amount of force normal to the opening leading into the speaker assembly of the electronic device. Generally speaking, configurations having a greater Z-component will result in magnetically attractable particles being drawn into the electronic device at a greater rate. The depicted field lines represent the Z-component of the magnitude of the magnetic field immediately outside electronic device 100 for various shielding configurations. Line 602 represents one of the depicted configurations, where a material along the lines of SUS-304 (a metal with substantially no magnetic permeability) is used to surround the magnetic component and no additional shielding is utilized. In such a case the Z-component of the magnetic force is concentrated near the center of the magnet, which unfortunately is located above a point of entry leading directly towards the magnetic element emitting the magnetic field. Line 604 represents a configuration in which SUS-430 is utilized to surround the magnet. In such a case the Z-component just above a central portion of the magnet is reduced by about one third. Line 606 represents a configuration in which mu-metal is used to line the enclosure for the magnet. While mu-metal generally has greater magnetic permeability than SUS-430 it tends to have weaker mechanical properties, requiring a thicker enclosure than one having the same strength but formed from SUS-430. Finally, line 608 represents a configuration similar to that shown in FIG. 5 where SUS-430 surrounds the magnet and mu-metals are included near the cosmetic mesh. By combining the magnetically permeable insert molding materials with the mu-metals near the surface of electronic device 100, the Z-component of the magnetic field extending outside electronic device 100 can be substantially distributed across the outside of electronic device 100.

Figure 7A:
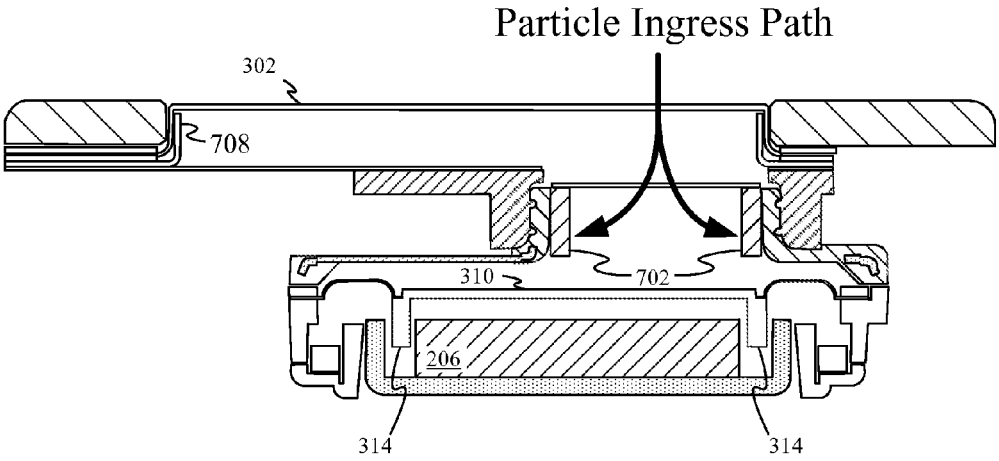
FIGS. 7A-7E show various alternative embodiments suitable for preventing magnetically attractable particles from accumulating on a diaphragm of the earpiece speaker assembly.
Figure 7B:
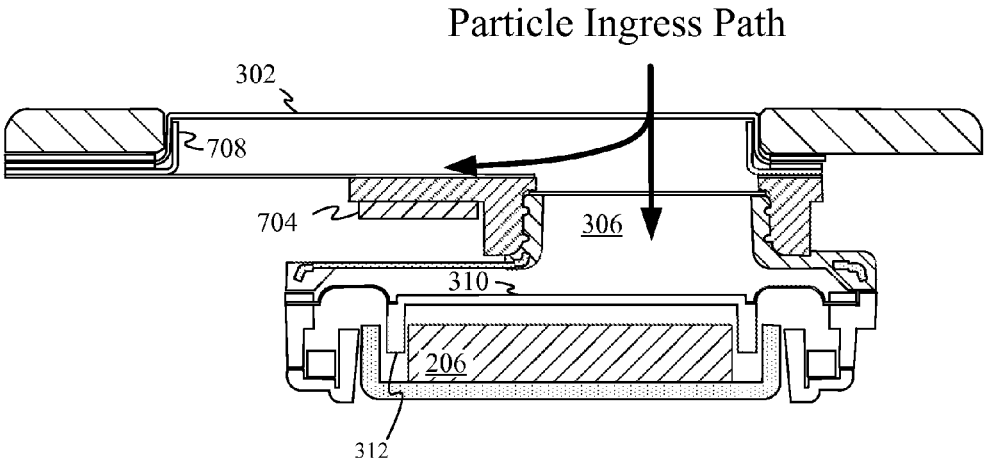

FIGS. 7A-7E show various alternative embodiments suitable for preventing ingressing magnetically attractable particles from accumulating on the diaphragm. In particular, FIG. 7A shows a configuration in which magnets 702 are positioned peripherally along the particle ingress path. In some embodiments, magnets 702 can attract magnetically attractable particles so they accumulate on magnets 702 as opposed to diaphragm 310. It should be noted that a size and strength of magnets 702 can be optimized to prevent or at least ameliorate any negative effects caused by interference between magnets 702 and a magnetic field emitted by magnet 206 or a shifting magnetic field emanated by electrically conductive coil 312. FIG. 7B another alternative embodiment in which a sacrificial magnet 704 is offset from snout region 204. Sacrificial magnet 704 can draw magnetically attractable particles away from snout region 204 as depicted in the arrows designated as the particle ingress path. In this position, sacrificial magnet 704 can have a substantial magnetic field that can divert magnetically attractable particles otherwise destined to accumulate on diaphragm 310 to a location above sacrificial magnet 704.

Figure 7C:
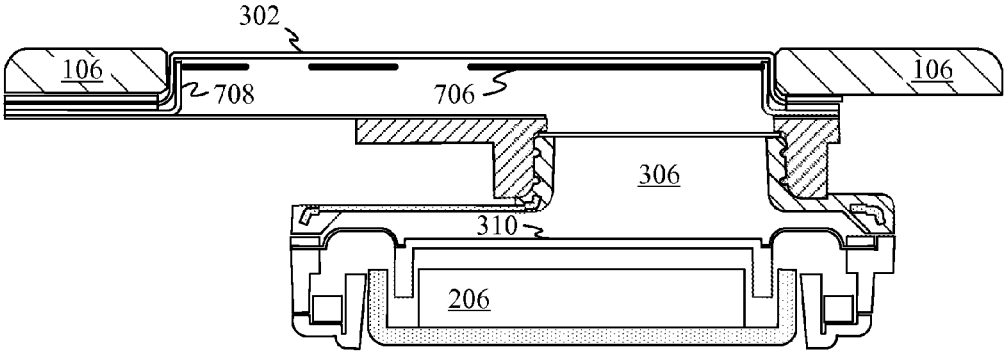
Figure 7D:
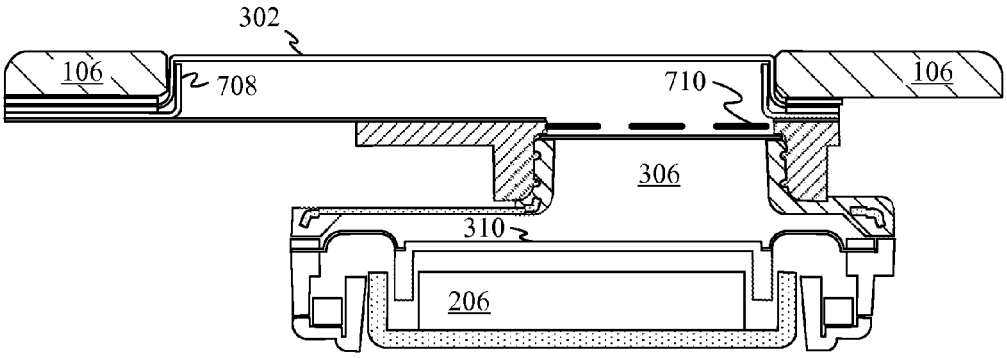
Figure 7E:
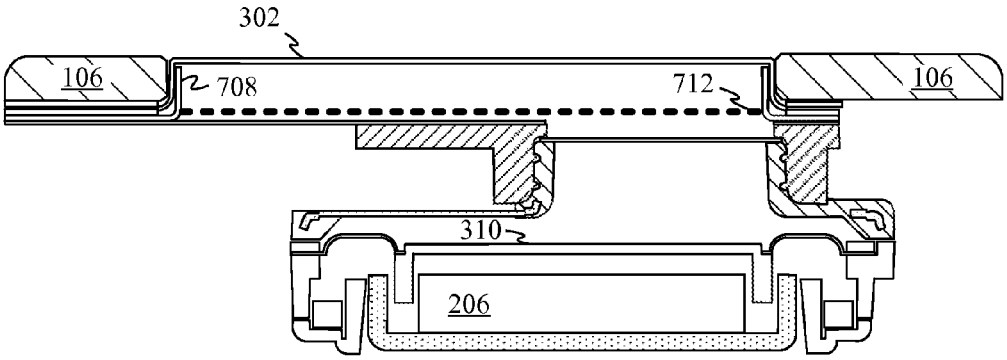

FIG. 7C shows another alternative embodiment in which an acoustic baffle 706 is added below cosmetic mesh 302. In some embodiments, cosmetic mesh stiffener 708 can be utilized to increase a stiffness of cosmetic mesh 302. In some embodiments, cosmetic stiffener 708 can also be utilized to support acoustic baffle 706 just below cosmetic mesh 302. By limiting ingress of magnetically attractable particles to a portion of the device that is not directly above snout region 204 an amount of magnetically attractable particles that arrive at diaphragm 310 can be reduced. FIG. 7D shows another alternative embodiment in which an acoustic baffle 710 is positioned directly above snout region 204. In this way, an additional layer of protection is positioned directly between diaphragm 310 and cosmetic mesh 302. FIG. 7E shows yet another alternative embodiment in which an acoustic baffle has relatively smaller openings than the previously described embodiments that are distributed across an area about the same as cosmetic mesh 302.

Figure 8:
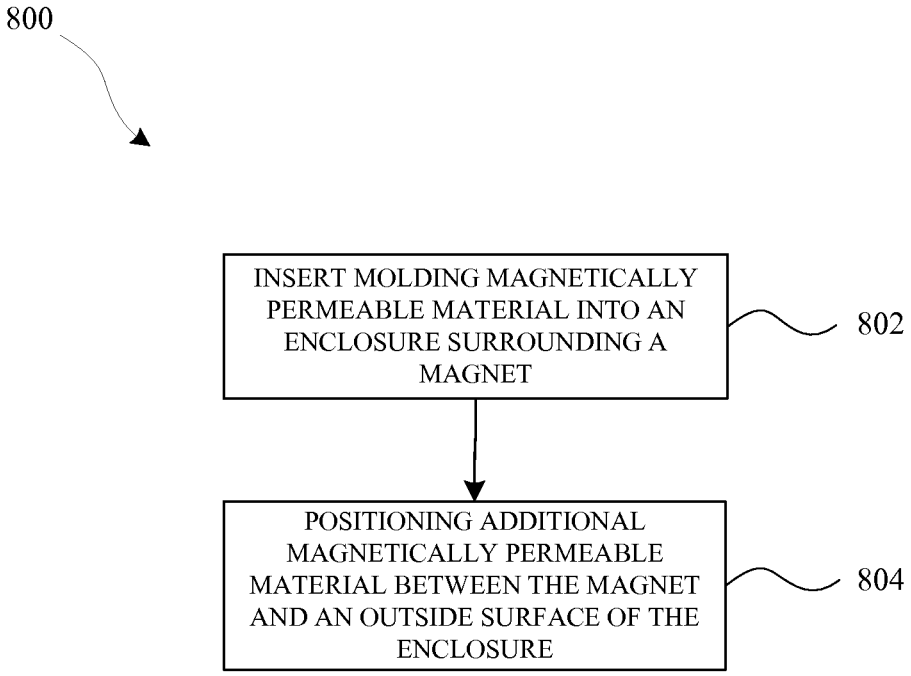
FIG. 8 shows a flow diagram representing a method for preventing the ingress of magnetically attractable particles into an electronic device.

FIG. 8 shows a block diagram representing a method for preventing the ingress of magnetically attractable particles into an electronic device. In a first step 802, magnetically permeable material is insert molded into an enclosure configured to surround a magnet. In some embodiments, the magnetically permeable material can be SUS-430, which has good magnetic permeability and structural characteristics. The structural or mechanical characteristics allow the magnetically permeable material to reinforce the enclosure surrounding the magnet. In some embodiments, using material with good structural characteristics can help to reduce a size or thickness of the enclosure. At step 804, additional magnetically permeable material can be added within the electronic device so that it is positioned between the magnet and an outside surface of the electronic device. The additional magnetically permeable material can be formed from a material chosen specifically for its high magnetic permeability, as the material need not perform or augment any structural features of the electronic device. In some embodiments, mu-metal can be used to fulfill this function. The mu-metal can be a nickel-iron alloy formed primarily from nickel but also including iron and smaller amounts of chromium or molybdenum. It should be noted that in addition to its high magnetic permeability, mu-metal tends to be ductile, which can make it easier for the material to be formed into a particular shape and location within the electronic device.

Figure 9:
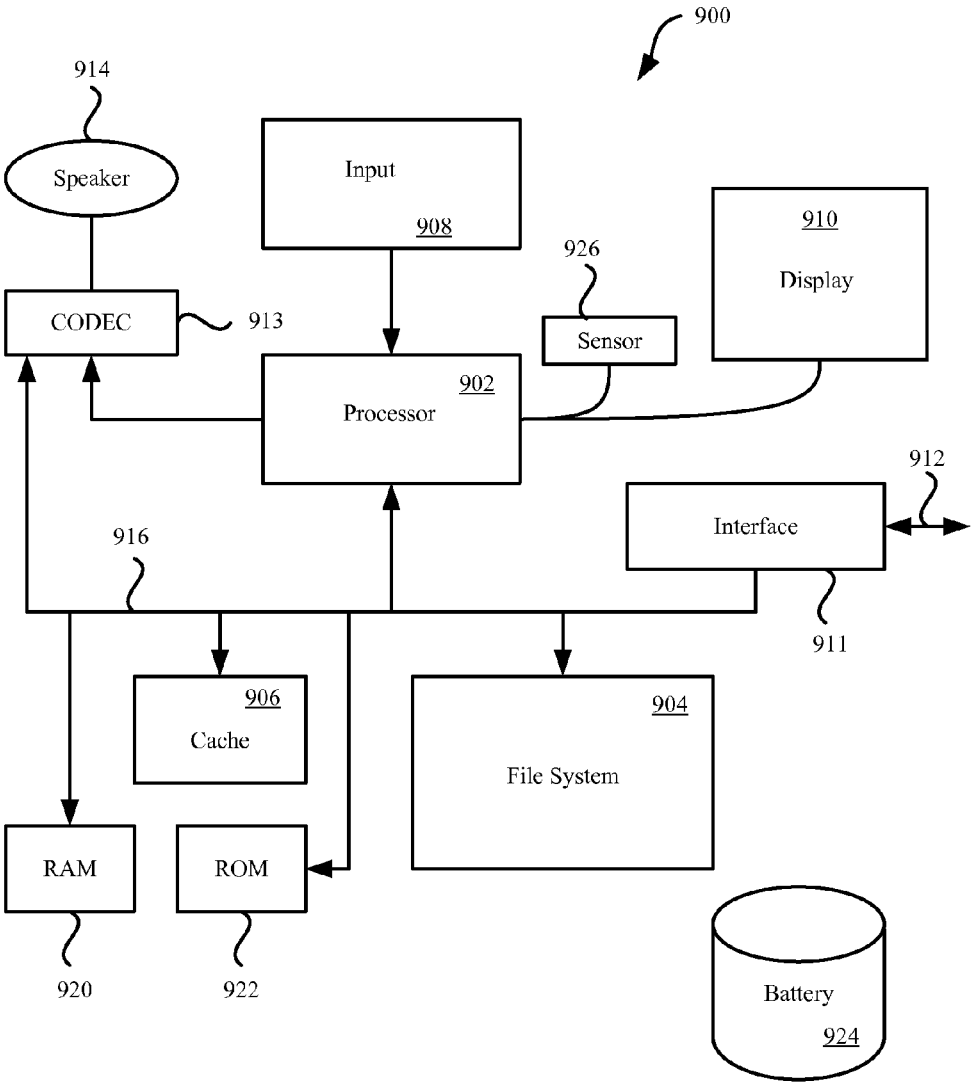
FIG. 9 shows a block diagram representing an electronic device suitable for controlling operations of internal components in accordance with the described embodiments.

FIG. 9 is a block diagram of electronic device 900 suitable for controlling operations of internal components in accordance with the described embodiments. Electronic device 900 illustrates circuitry of a representative computing device. Electronic device 900 includes a processor 902 that pertains to a microprocessor or controller for controlling the overall operation of electronic device 900. Electronic device 900 contains instruction data pertaining to manufacturing instructions in a file system 904 and a cache 906. The file system 904 is, typically, a storage disk or a plurality of disks. The file system 904 typically provides high capacity storage capability for the electronic device 900. However, since the access time to the file system 904 is relatively slow, the electronic device 900 can also include a cache 906. The cache 906 is, for example, Random-Access Memory (RAM) provided by semiconductor memory. The relative access time to the cache 906 is substantially shorter than for the file system 904. However, the cache 906 does not have the large storage capacity of the file system 904. Further, the file system 904, when active, consumes more power than does the cache 906. The power consumption is often a concern when the electronic device 900 is a portable device that is powered by a battery 924. The electronic device 900 can also include a RAM 920 and a Read-Only Memory (ROM) 922. The ROM 922 can store programs, utilities or processes to be executed in a non-volatile manner. The RAM 920 provides volatile data storage, such as for cache 906.

The electronic device 900 also includes a user input device 908 that allows a user of the electronic device 900 to interact with the electronic device 900. For example, the user input device 908 can take a variety of forms, such as a button, keypad, dial, touch screen, audio input interface, visual/image capture input interface, input in the form of sensor data, etc. Still further, the electronic device 900 includes a display 910 (screen display) that can be controlled by the processor 902 to display information to the user. A data bus 916 can facilitate data transfer between at least the file system 904, the cache 906, the processor 902, and a CODEC 913. The CODEC 913 can be used to decode and play a plurality of media items from file system 904 that can correspond to certain activities taking place during a particular manufacturing process. The processor 902, upon a certain manufacturing event occurring, supplies the media data (e.g., audio file) for the particular media item to a coder/decoder (CODEC) 913. The CODEC 913 then produces analog output signals for a speaker 914. The speaker 914 can be a speaker internal to the electronic device 900 or external to the electronic device 900. For example, headphones or earphones that connect to the electronic device 900 would be considered an external speaker.

The electronic device 900 also includes a network/bus interface 911 that couples to a data link 912. The data link 912 allows the electronic device 900 to couple to a host computer or to accessory devices. The data link 912 can be provided over a wired connection or a wireless connection. In the case of a wireless connection, the network/bus interface 911 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 926 can take the form of circuitry for detecting any number of stimuli. For example, sensor 926 can include any number of sensors for monitoring various operating conditions of electronic device 900, such as for example a Hall Effect sensor responsive to external magnetic field, a temperature sensor, an audio sensor, a light sensor such as a photometer, a depth measurement device such as a laser interferometer and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A speaker assembly for an electronic device, the speaker assembly comprising:

a speaker, comprising a magnetic element that emits a magnetic field used to actuate an acoustic membrane that generates audio signals during operation of the speaker assembly; and a speaker enclosure substantially surrounding the speaker assembly and defining an opening that provides an outlet for the audio signals generated by the acoustic membrane, the speaker enclosure comprising magnetically permeable material distributed around the opening in a manner that redirects the magnetic field so that magnetically attractable particles from an external environment are inhibited from being magnetically drawn through the opening.

2. The speaker assembly as recited in claim 1, wherein the redirection of the magnetic field by the magnetically permeable material reorients a plurality of magnetic field lines of the magnetic field away from a direction normal to an entrance into the opening defined by the speaker enclosure.

3. The speaker assembly as recited in claim 2, wherein magnetic forces generated by the magnetic field and exerted upon the magnetically attractable particles are directed away from the opening as a result of the reorienting of the plurality of magnetic field lines.

4. The speaker assembly as recited in claim 3, wherein the speaker further comprises:

an electrically conductive ring across which the acoustic membrane is stretched, the electrically conductive ring being electrically coupled with a power supply;

wherein the power supply is configured to supply modulated electrical current to the electrically conductive ring to produce a modulating magnetic field that interacts with the magnetic field emitted by the magnetic element that causes the acoustic membrane to vibrate in accordance with audio information received by the electronic device.

5. The speaker assembly as recited in claim 4, wherein the electrically conductive ring is flexibly coupled to interior surfaces of the speaker enclosure, the flexible coupling aligning a longitudinal axis of the electrically conductive ring with a pole of the magnetic element.

6. The speaker assembly as recited in claim 4, wherein the opening defined by the speaker enclosure exposes at least half of the acoustic membrane.

7. The speaker assembly as recited in claim 2, wherein the speaker enclosure further comprises molding material insert molded around the magnetically permeable material.

8. A speaker assembly configured to be affixed to an interior surface of a housing of an electronic device, the speaker assembly comprising:

a speaker enclosure defining an opening leading towards a position at which an opening in the interior surface of the housing is positioned when the speaker assembly is affixed to the interior surface of the housing, the speaker enclosure comprising magnetically permeable material arranged around the opening defined by the speaker enclosure;

a magnet disposed within and substantially surrounded by the speaker enclosure;

an electrically conductive ring electrically coupled with a power supply that supplies the electrically conductive ring with modulated current during operation of the speaker assembly; and a diaphragm coupled with and disposed across the electrically conductive ring, wherein the electrically conductive ring and the magnet cooperate to vibrate the electrically conductive ring so that the diaphragm generates an audio signal that is transmitted through the opening defined by the speaker enclosure, and wherein the magnetically permeable material is positioned to redirect portions of magnetic fields emitted by the speaker assembly that extend outside of the electronic device to reduce a rate at which magnetically attractable particles are drawn into the speaker assembly.

9. The speaker assembly as recited in claim 8, wherein the rate at which the magnetically attractable particles are drawn into the speaker assembly is reduced by reorienting a plurality of magnetic field lines of the portion of the magnetic fields away from a direction normal to an entrance into the opening in the interior surface of the housing.

10. The speaker assembly as recited in claim 8, wherein an acoustic mesh is positioned across the opening leading out of the speaker enclosure.

11. The speaker assembly as recited in claim 8, wherein the magnetically permeable material of the speaker enclosure is concentrated between the magnet and the interior surface of the housing.

12. The speaker assembly as recited in claim 8, wherein the diaphragm is formed from paper.

13. The speaker assembly as recited in claim 8, wherein the magnetically permeable material comprises stainless steel.

14. The speaker assembly as recited in claim 8, further comprising additional magnetically permeable material formed of mu-metal.

15. The speaker assembly as recited in claim 8, further comprising a layer of cosmetic mesh configured to cover the opening in the interior surface defined by the housing.

16. The electronic device as recited in claim 8, wherein the speaker enclosure further comprises a magnetic shunt that supports the magnet and forms at least a portion of one side of the speaker enclosure, and wherein the magnetic shunt interlocks with an injection molded portion of the speaker enclosure to position the magnet proximate to the electrically conductive ring.

17. The electronic device as recited in claim 16, wherein the magnetic field emitted by the magnet is substantially aligned with the resulting magnetic field emitted by the electrically conductive ring.

18. An electronic device, comprising:

a device housing defining a speaker opening; and a speaker assembly affixed to an interior facing surface of the device housing that includes the speaker opening, the speaker assembly comprising: a speaker enclosure defining an opening oriented towards the speaker opening in the interior facing surface of the device housing, the speaker enclosure comprising magnetically permeable material distributed around the opening defined by the speaker enclosure, a magnet disposed within and substantially surrounded by the speaker enclosure, and an acoustic membrane stretched over an electrically conductive ring, the electrically conductive ring configured to emit a shifting magnetic field that cooperates with a magnetic field emitted by the magnet to cause the acoustic membrane to generate an audio output that is transmitted through the opening of the speaker enclosure and the speaker opening, and wherein the magnetically permeable material is positioned to redirect a portion of the magnetic field emitted by the magnet from extending outside of the electronic device.

19. The electronic device as recited in claim 18, wherein a rate at which magnetically attractable particles are drawn into the speaker enclosure by the magnetic field is reduced by reorienting a plurality of magnetic field lines of the magnetic field away from a direction normal to an entrance into the speaker opening.

* * * * *